US007736199B2

(12) United States Patent
Cossette

(10) Patent No.: US 7,736,199 B2
(45) Date of Patent: Jun. 15, 2010

(54) CONTACT RETENTION ASSEMBLY

(75) Inventor: Luke Antonio Cossette, Rochester, MN (US)

(73) Assignee: Tyco Electronics Corp., Berwyn, PA (US)

( * ) Notice: Subject to any disclaimer, the term of this patent is extended or adjusted under 35 U.S.C. 154(b) by 15 days.

(21) Appl. No.: 12/184,425

(22) Filed: Aug. 1, 2008

(65) Prior Publication Data

US 2010/0029143 A1 Feb. 4, 2010

(51) Int. Cl.
*H01R 13/434* (2006.01)

(52) U.S. Cl. ..... 439/745

(58) Field of Classification Search ..... 439/745, 439/744, 595, 724
See application file for complete search history.

(56) References Cited

U.S. PATENT DOCUMENTS 3,383,642 A * 5/1968 Nava et al. ..... 439/724
3,475,720 A * 10/1969 Culver ..... 439/744
3,697,935 A * 10/1972 Drapkin ..... 439/744
4,082,398 A * 4/1978 Bourdon et al. ..... 439/595
4,241,976 A 12/1980 Oliver et al.
4,333,703 A 6/1982 Anhalt et al.
4,362,350 A 12/1982 von Harz
4,804,243 A 2/1989 Borsuk et al.
5,643,016 A 6/1997 Huss, Jr.

* cited by examiner

*Primary Examiner*—Jean F Duverne

(57) ABSTRACT

A contact retention assembly includes a body, an outward angled tine and an inward angled tine. The body extends between a front end and a back end. The outward angled tine extends from the body to a housing engagement surface and is configured to engage a portion of a housing. The inward angled tine extends from the body to a contact engagement surface and is configured to engage a contact in order to retain the contact within the assembly. The inward angled tine extends from the body in a different direction than the outward angled tine.

20 Claims, 7 Drawing Sheets

CONTACT RETENTION ASSEMBLY

BACKGROUND OF THE INVENTION

The subject matter herein relates generally to electrical connectors, and more particularly, to assemblies for retaining contacts in electrical connectors.

Contacts in known connectors may be used to provide current from one connector to another connector. In connectors configured to provide relatively low amounts of current, the contacts may be secured in the connector by pressing the contact into a housing of the connector. However, for known connectors configured to provide relatively high amounts of current, the contacts are screw machined so that the contacts may have a higher current carrying capability. These screw machined contacts may not be secured in the connector by pressing the contacts into the housing. Instead, the contacts are secured in the connector by placing a contact clip around the contact in an opening on the contact loading side, or the side that opposes the mating side, of the housing. The contact clip includes extensions that engage the contact. In order to prevent the contact clip and the contact from being removed from the housing a second housing component is placed over the contact loading side of the housing. The second housing component secures the contact clip within the housing. The contact clip secures the contact within the housing. The addition of a second housing component to these known connectors increases the cost and complexity of manufacturing the connectors. In other known connectors, the contact clips are held in place by heat-staking within a plastic housing or through other external means.

Thus, a need exists for a connector having a contact retention assembly that prevents the contact from being removed from the connector housing, while reducing the cost and simplifying the complexity of manufacturing the connector.

BRIEF DESCRIPTION OF THE INVENTION

In one embodiment, a contact retention assembly includes a body, an outward angled tine and an inward angled tine. The body extends between a front end and a back end. The outward angled tine extends from the body to a housing engagement surface and is configured to engage a portion of a housing. The inward angled tine extends from the body to a contact engagement surface and is configured to engage a contact in order to retain the contact within the assembly. The inward angled tine extends from the body in a different direction than the outward angled tine.

In one embodiment, a connector assembly includes a housing and a contact retention assembly. The housing extends between a mating side and an opposing side. The mating side is configured to mate with a mating connector. The opposing side includes a contact opening that is configured to receive a contact. The contact retention assembly is disposed in the contact opening and includes an outward angled tine and an inward angled tine. The outward angled tine has an outward tine end that faces the opposing side and engages the housing to prevent the contact retention assembly from being removed from the housing through the contact opening. The inward angled tine has an inward tine end that faces the mating side and is configured to engage the contact to prevent the contact from being removed from the housing through the contact opening.

DETAILED DESCRIPTION OF THE INVENTION

Figure 1:
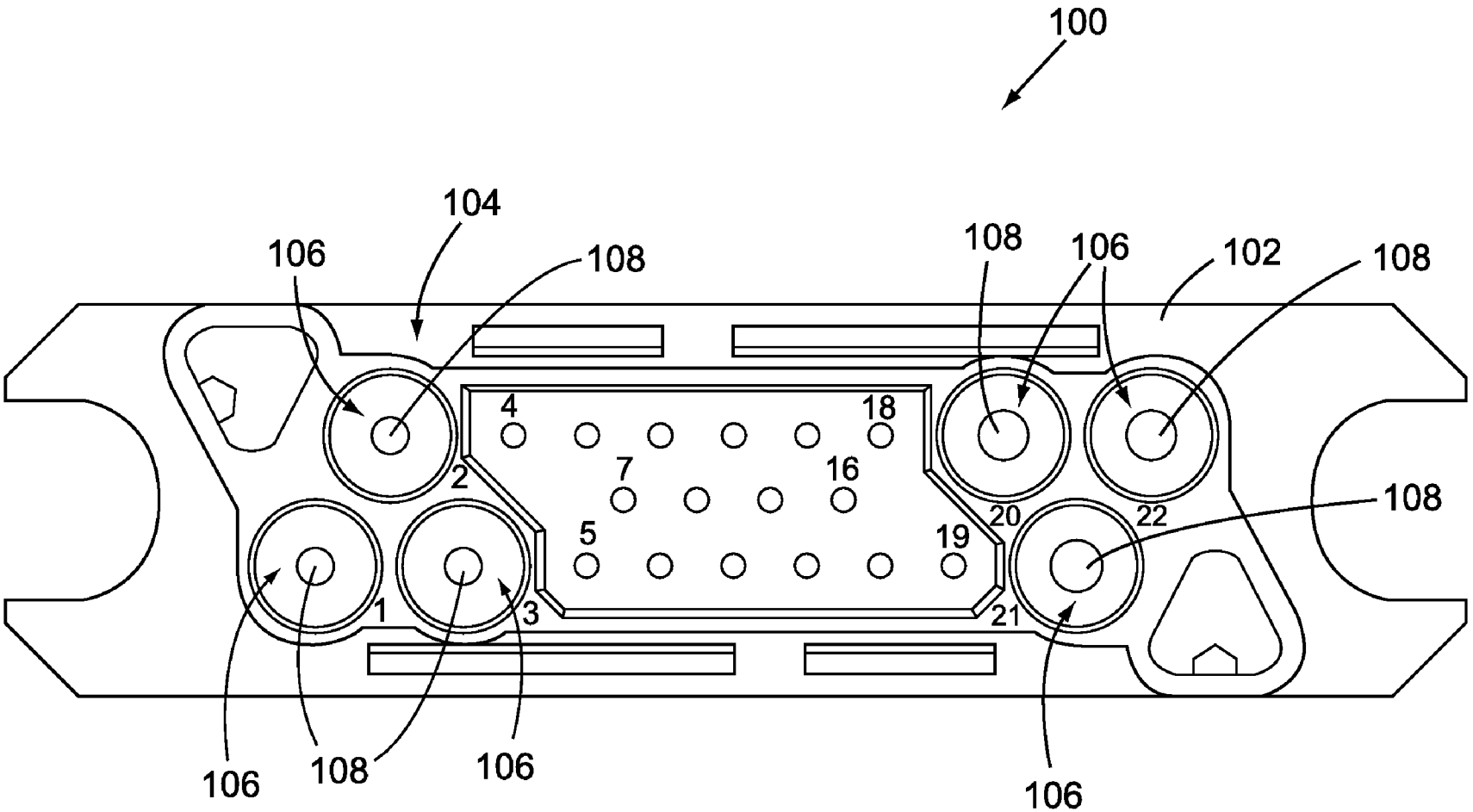
FIG. 1 is a plan view of a known connector assembly.

FIG. 1 is a plan view of a known connector assembly 100. The connector assembly 100 includes a housing 102 that extends between a mating side 104 and a contact loading side 200 (shown in FIG. 2). The mating side 104 is configured to mate with a mating connector (not shown). The connector assembly 100 may be a high current power connector. For example, the connector assembly 100 may be a docking connector that is mounted to a backplane circuit board and is configured to mate with a mating connector to provide alternating current ("AC") to the circuit board. The connector assembly 100 may be a plug connector or a receptacle connector, for example. The housing 102 includes a plurality of contact openings 106 at the mating side 104 with a contact 108 disposed within each contact opening 106.

Figure 2:
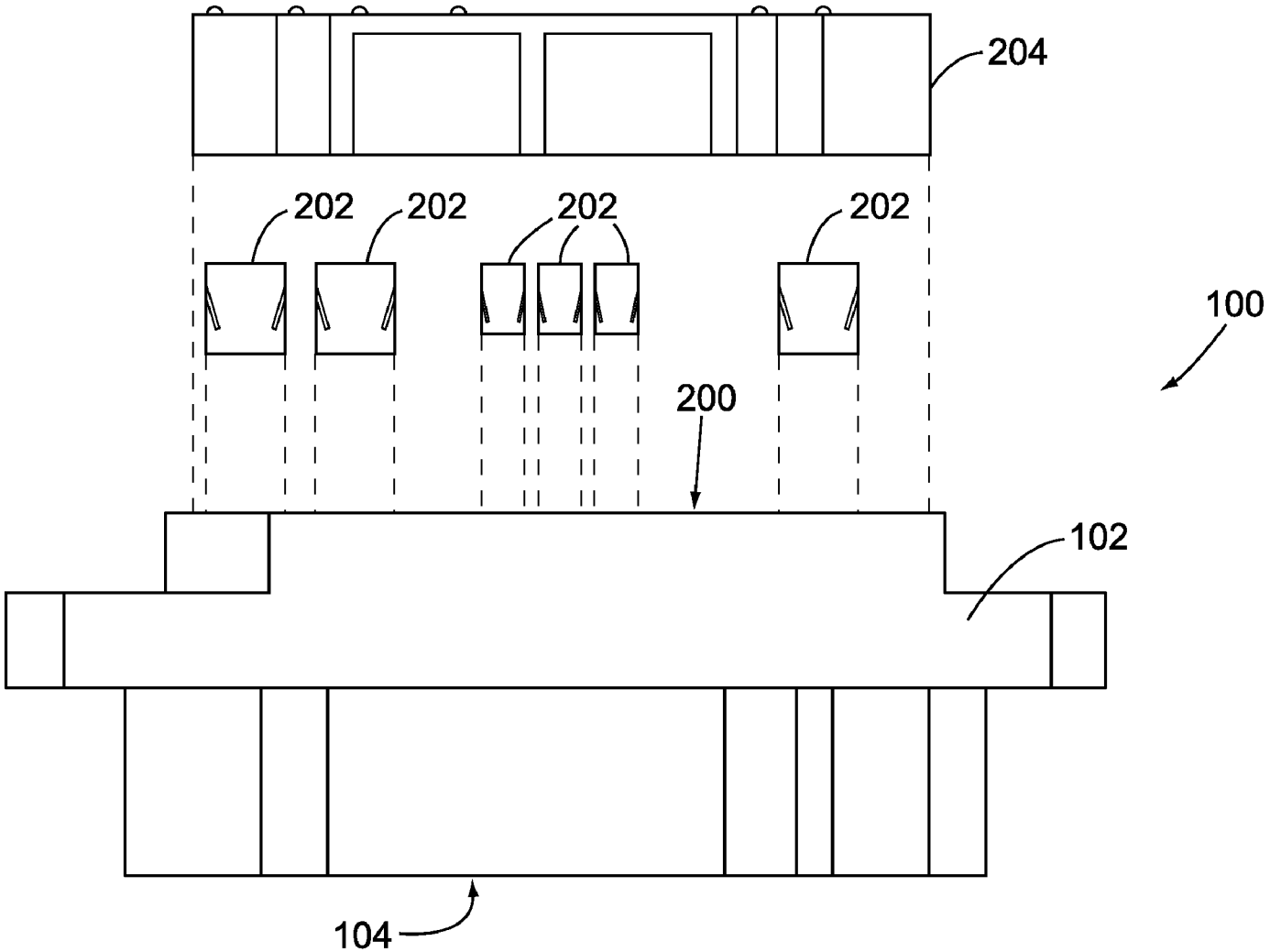
FIG. 2 is an exploded view of the connector assembly shown in FIG. 1.

FIG. 2 is an exploded view of the connector assembly 100. As shown in FIG. 2, the mating and contact loading sides 104, 200 of the housing 102 oppose one another. Several contact retention bodies 202 are loaded into the housing 102 from the contact loading side 200. The contact retention bodies 202 are loaded into cavities (not shown) that extend into the housing 102 from the contact loading side 200. The contact retention bodies 202 are loaded into the housing 102 so as to surround corresponding contacts 108 (shown in FIG. 1) in the housing 102. A second housing component 204 is then loaded into the housing 102 from the contact loading side 200 to secure the contact retention bodies 202 in the housing 102. The contact retention bodies 202 each prevent a corresponding contact 108 from being removed from the housing 102, while the second housing component 204 prevents the contact retention bodies 202 from being removed from the housing 102. As described above, known connector assemblies 100 require the use of contact retention bodies 202 in addition to the second housing component 204 in order to secure the contacts 108 within the housing 102.

Figure 3:
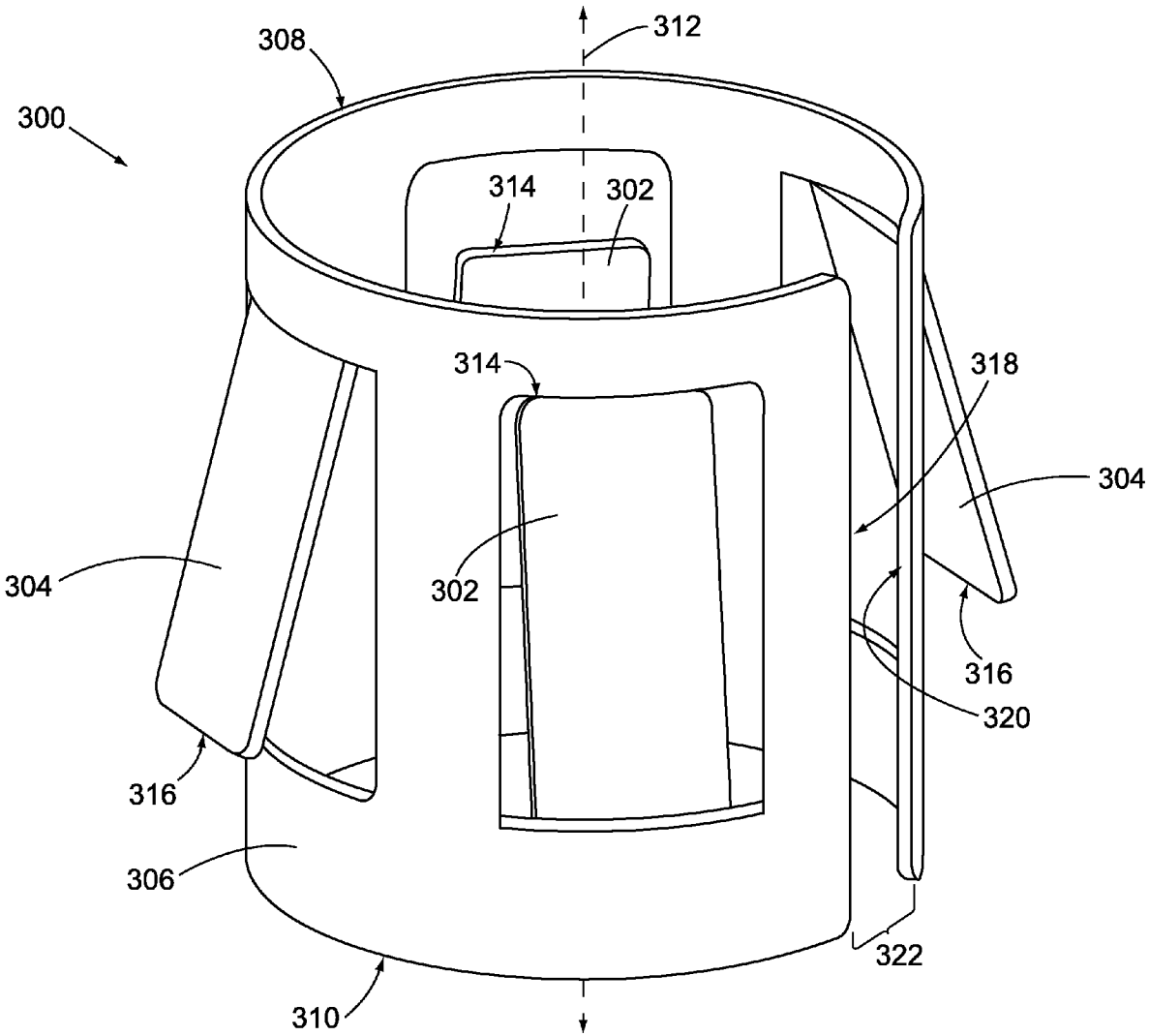
FIG. 3 is a perspective view of a contact retention assembly according to one embodiment.

FIG. 3 is a perspective view of a contact retention assembly 300 according to one embodiment. The contact retention assembly 300 may be used to retain contacts (not shown) in a connector assembly (not shown) without the need for additional, separate housing components to secure the contact retention assembly 300 in the connector assembly. For example, the contact retention assembly 300 may retain contacts in a housing (not shown) of a connector assembly and resist being removed from the housing without the addition of another housing component to secure the contact retention assembly 300. In one embodiment, the contact retention assembly 300 may be used with a connector assembly similar to the connector assembly 100 (shown in FIG. 1) to secure the contacts 108 (shown in FIG. 1), with the exception that the second housing component 204 (shown in FIG. 2) may not be needed to secure the contacts 108 in the housing 102 (shown in FIG. 1). For example, the connector assembly 100 may not include an opening or other cavity that is shaped to receive the second housing component 204 to secure the contact retention assemblies 300 in the housing 102.

The contact retention assembly 300 includes a plurality of inward angled tines 302 and a plurality of outward angled tines 304. In one embodiment, the inward and outward angled tines 302, 304 are cantilevered beams. The inward angled tines 302 and outward angled tines 304 may be integrally formed with a body 306 of the contact retention assembly 300. For example, the body 306 and inward and outward angled tines 302, 304 may be stamped and formed from a sheet of material, such as a metal. Alternatively, the inward and outward angled tines 302, 304 may be formed separately from the body 306 and then attached to the body 306. The body 306 may have a substantially tubular shape that extends between front and back ends 308, 310. The body 306 may be approximately centered about a central axis 312.

In the illustrated embodiment, the inward and outward angled tines 302, 304 extend from the body 306 in different directions. Each of the inward angled tines 302 extends between the body 306 and a contact engagement surface 314. The contact engagement surfaces 314 face in substantially the same direction as the front end 308 of the body 306. The outward angled tines 304 extend between the body 306 and a housing engagement surface 316. The housing engagement surfaces 316 face in substantially the same direction as the back end 310 of the body 306. The inward angled tines 302 are connected to the body 306 in a location that is closer to the back end 310 than the front end 308 of the body 306. The outward angled tines 304 are connected to the body 306 in a location that is closer to the front end 308 than the back end 310.

As shown in the illustrated embodiment, the inward angled tines 302 are slightly bent so as to be angled towards the inside of the body 306 and the central axis 312. The outward angled tines 304 are slightly bent in an opposite direction so as to be angled away from the inside of the body 306 and the central axis 312. The inward angled tines 302 may oppose one another and the outward angled tines 304 may oppose one another. In one embodiment, each of the inward angled tines 302 is located between two outward angled tines 304 and each of the outward angled tines 304 is located between two inward angled tines 302. For example, each of the inward and outward angled tines 302, 304 may be separated from one another by approximately 90 degrees along the substantially circular cross-section of the body 306. While two inward angled tines 302 and two outward angled tines 304 are shown in the illustrated embodiment, a different number of inward angled tines 302 and/or outward angled tines 304 may be provided.

The body 306 circumferentially extends between opposing ends 318, 320 in the illustrated embodiment. The opposing ends 318, 320 may be separated from one another by a gap 322, as shown in the illustrated embodiment, or may be joined together. For example, the opposing ends 318, 320 may be soldered or otherwise secured together. In one embodiment, the diameter of the contact retention assembly 300 may be slightly reduced prior to loading the contact retention assembly 300 by biasing the opposing ends 318, 320 towards one another and reducing the size of the gap 322. Once the contact retention assembly 300 is loaded in a housing 402 (shown in FIG. 4) of a connector assembly 510 (shown in FIG. 5), the opposing ends 318, 320 may be released and return the gap 322 to the original size of the gap 322. The contact retention assembly 300 has a substantially circular cross-section in the illustrated embodiment. In another embodiment, the contact retention assembly 300 has a cross-section that is substantially in the shape of a polygon. For example, the cross-section of the contact retention assembly 300 may be a triangle, a square, a rectangle, and the like.

Figure 4:
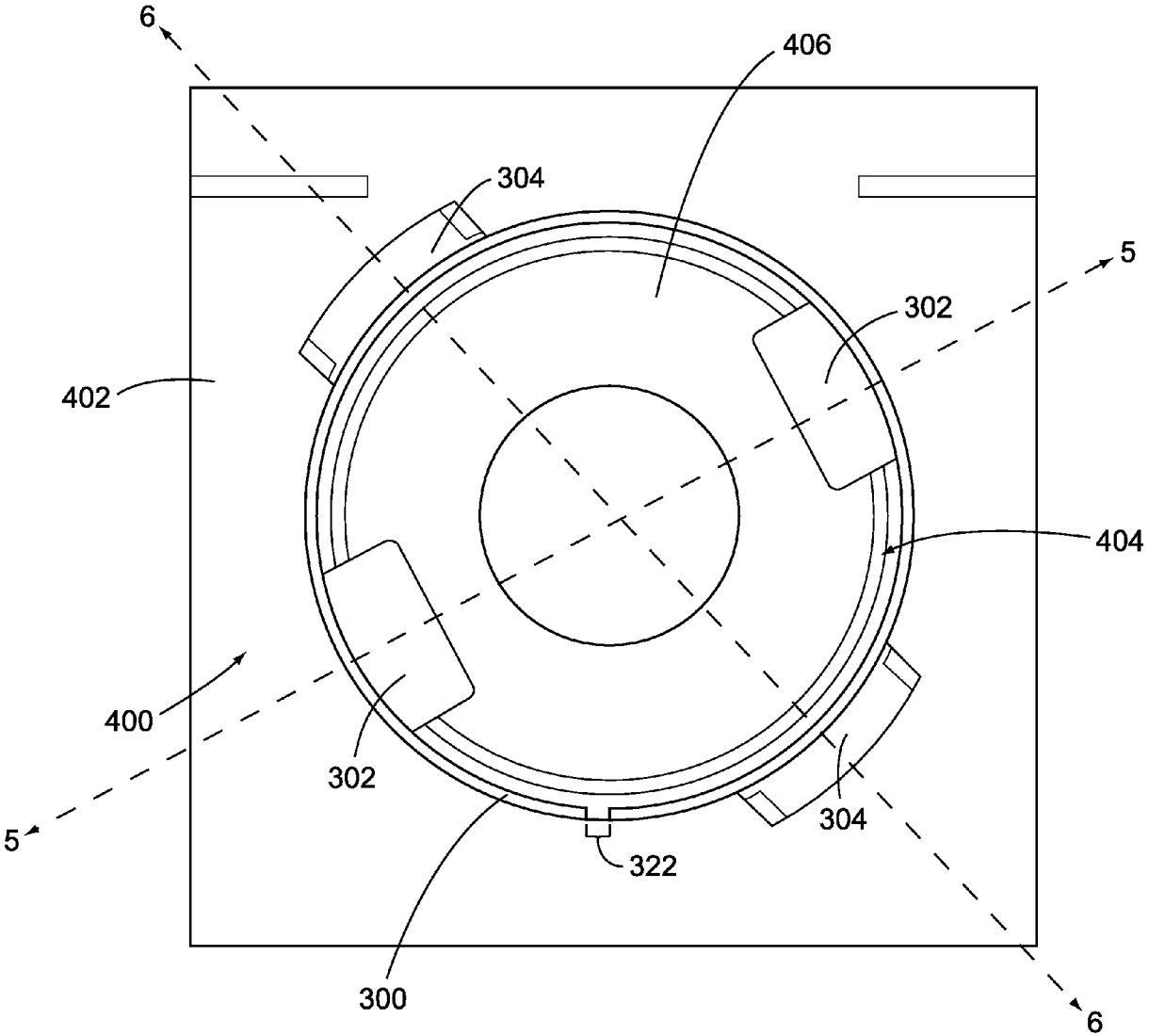
FIG. 4 is a plan view of a portion of a contact loading side of a housing for a connector assembly (shown in FIG. 5) according to one embodiment.

FIG. 4 is a plan view of a portion of a contact loading side 400 of a housing 402 for a connector assembly 510 (shown in FIG. 5) according to one embodiment. The connector assembly 510 may be similar to the connector assembly 100 shown in FIG. 1. For example, the connector assembly 510 may include a mating side 508 (shown in FIG. 5) that is similar to the mating side 104 and is configured to mate with a mating connector (not shown). The connector assembly 510 also may include the contact loading side 400 that is similar to the contact loading side 200 (shown in FIG. 2), with the exception that the contact loading side 200 may not include a cavity or opening configured to receive the second housing component 204 (shown in FIG. 2), for example.

The contact loading side 400 includes one or more contact openings 404. The contact openings 404 may be cavities in the housing 402 that extend from the contact loading side 400 towards the mating side 508 (shown in FIG. 5). A contact 406 may be provided in the contact opening 404. In one embodiment, the contact 406 is similar to the contact 108 (shown in FIG. 1). As shown in FIG. 4, the contact retention assembly 300 extends around substantially the entire inside circumference of the contact opening 404. For example, with the exception of the gap 322, the contact retention assembly 300 extends around the entire inside circumference of the contact opening 404. The inward angled tines 302 engage the contact 406 to prevent the contact 406 from being removed from the contact retention assembly 300 in a direction through the contact loading side 400. The outward angled tines 304 engage the housing 402 underneath the contact loading side 400 to prevent the contact retention assembly 300 from being removed through the contact loading side 400. The inward and outward angled tines 302, 304 may then prevent the contact 406 from being removed through the contact loading side 400.

Figure 5:
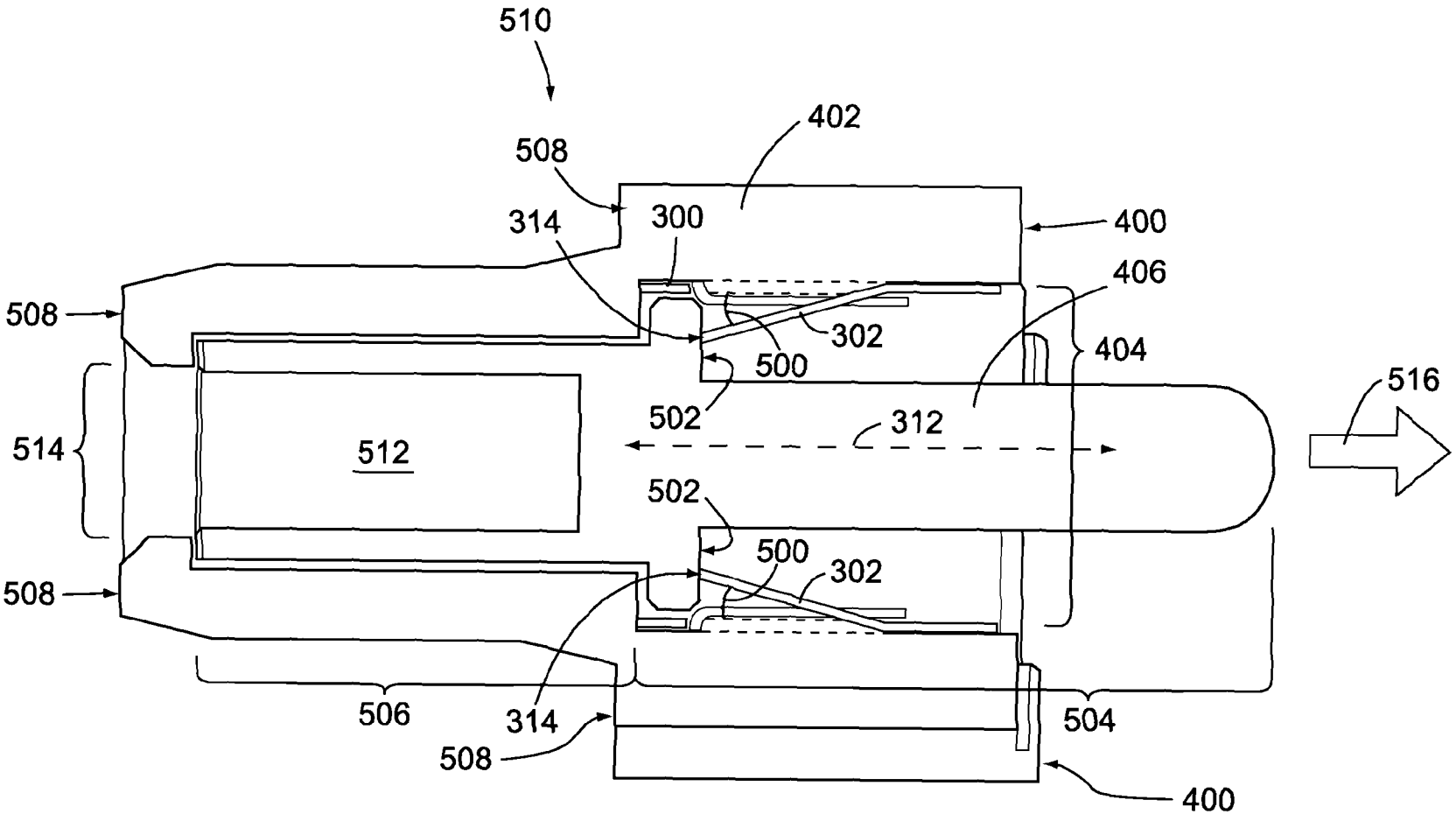
FIG. 5 is a cross-sectional view of the portion of the housing shown in FIG. 4 across line 5-5 in FIG. 4.

FIG. 5 is a cross-sectional view of the portion of the housing 402 across line 5-5 in FIG. 4. As shown in FIG. 5, the connector assembly 510 extends between the contact loading side 400 and the mating side 508. The contact opening 404 may extend from the contact loading side 400 towards the mating side 508. The inward angled tines 302 of the contact retention assembly 300 extend towards the central axis 312 at an inward angle 500. In one embodiment, the contact 406 includes a contact flange 502. The contact flange 502 may extend around a portion or all of the contact 406. The contact flange 502 extends radially outward from a mounting portion 504 of the contact 406. The mounting portion 504 may include a part of the contact 406 that is mounted to a circuit board (not shown) or other peripheral device (not shown) to electrically connect the contact 406 and the circuit board or other peripheral device. For example, part of the mounting portion 504 may be inserted into and affixed to a circuit board.

The contact 406 may include an engagement portion 506 on an end opposing the mounting portion 504. In the illustrated embodiment, the engagement portion 506 includes a receptacle cavity 512. The receptacle cavity 512 may receive a mating contact (not shown) in a mating connector (not shown) that mates with the connector assembly 510. For example, the mating connector may include a mating contact that is inserted through a mating side opening 514 in the mating side 508 of the housing 402 in order to insert the mating contact into the receptacle cavity 512 and electrically connect the mating contact and the contact 406. In another embodiment, the contact 406 includes a pin or other protrusion (not shown) that is inserted into the mating contact of a mating connector. For example, the contact 406 may include a pin that is inserted into a receptacle cavity (not shown) of the mating connector.

As shown in FIG. 5, the inward angled tines 302 are bent inward toward the contact 406 so that the contact engagement surfaces 314 engage and/or block the contact flange 502. In one embodiment, the contact engagement surfaces 314 may not directly contact the contact flange 502 until the contact 406 is displaced in a direction indicated by the arrow 516 in FIG. 5. The inward angled tines 302 prevent the contact 406 from being removed from the housing 402 through the contact loading side 400. The inward angled tines 302 may be biased outwards away from the contact 406 in order to release the contact 406 and permit the contact 406 to be removed from the housing 402 through the contact loading side 400. For example, a tool or other object (not shown) may be inserted into the contact opening 404 between the contact 406 and the contact retention assembly 300. The tool may then bias the inward angled tines 302 away from the contact 406 until the contact engagement surfaces 314 no longer contact or engage the contact flange 502, or until the contact engagement surfaces 314 are no longer positioned to contact or engage the contact flange 502 when the contact 406 is displaced in the direction of the arrow 516. The contact 406 may then be removed from the housing 402. In one embodiment, the inward angled tines 302 are biased away from the contact 406 so that the contact 406 is removed from the housing 402 while the contact retention assembly 300 is prevented from being removed from the housing 402. For example, the inward angled tines 302 may be biased away from the contact 406 to the positions shown by the dashed lines in FIG. 5 while the outward angled tines 304 (shown in FIG. 3) remain bent outwards and engaged with the housing 402 in order to prevent removal of the contact retention assembly 300 through the contact loading side 400.

In an alternative embodiment, rather than engaging the contact flange 502 to prevent the contact 406 from being removed from the housing 402, the inward angled tines 302 may engage another feature of the contact 406. For example, the inward angled tines 302 may engage one or more recesses (not shown), shoulders, protrusions or other features in the contact 406.

Figure 6:
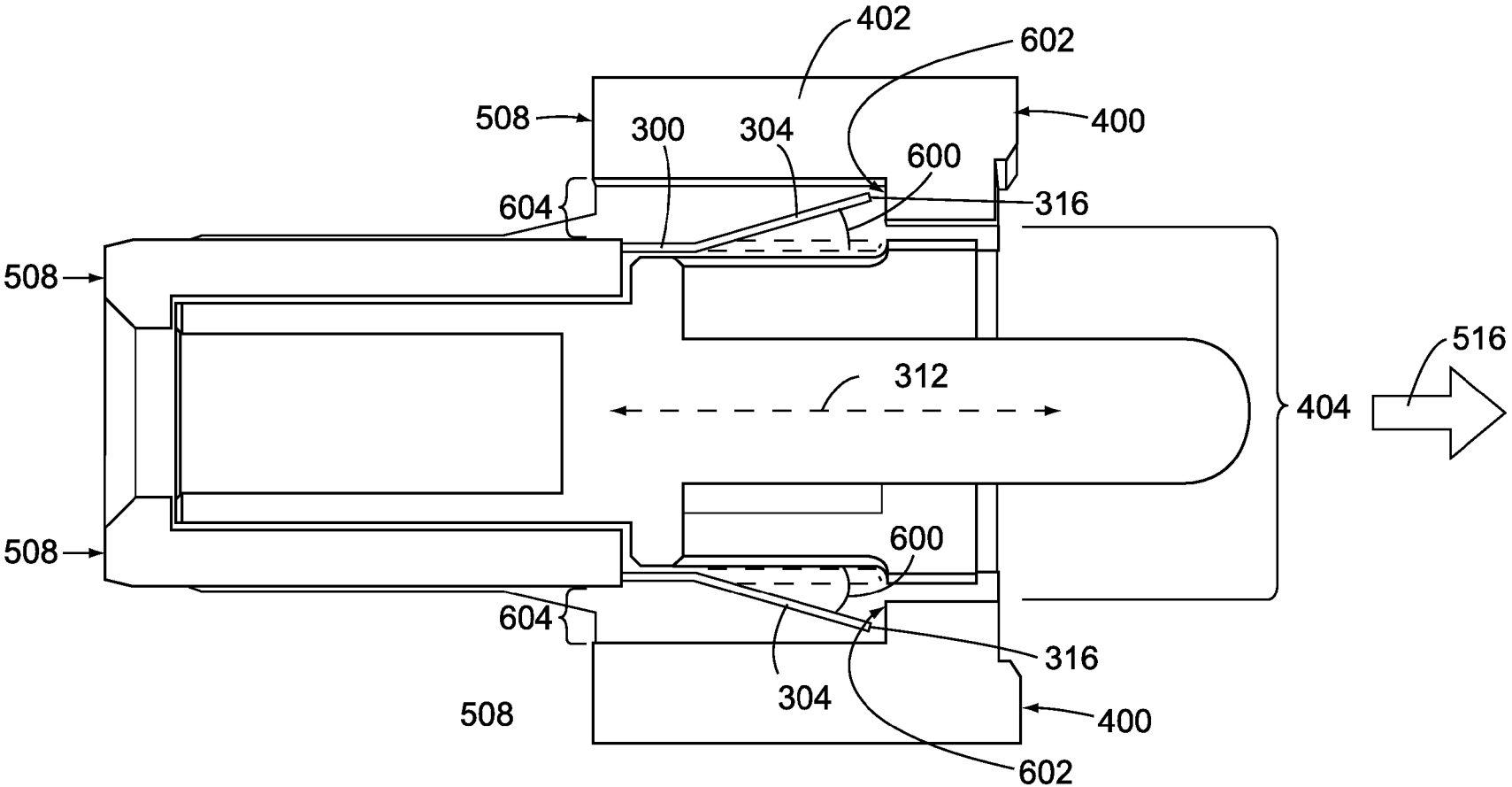
FIG. 6 is a cross-sectional view of the portion of the housing shown in FIG. 4 across line 6-6 in FIG. 4.

FIG. 6 is a cross-sectional view of the portion of the housing 402 across line 6-6 in FIG. 4. As shown in FIG. 6, the outward angled tines 304 extend away from the central axis 312 at an outward angle 600. In one embodiment, the inward angle 500 (shown in FIG. 5) of the inward angled tines 302 (shown in FIG. 3) is approximately the same as the outward angle 600. Alternatively, the inward and outward angles 500, 600 differ from one another.

The housing 402 may include a housing ledge 602 that extends around at least a portion of the inside circumference of the contact opening 404. The outward angled tines 304 may be bent outward away from the contact 406 so that the housing engagement surfaces 316 engage the housing ledge 602. In one embodiment, the housing engagement surfaces 316 may not directly contact the housing ledge 602 until the contact 406 and contact retention assembly 300 are displaced in a direction indicated by the arrow 516. In such an embodiment, the contact 406 may be able to float within the housing 402. The outward angled tines 304 prevent the contact retention assembly 300 from being removed from the housing 402 through the contact loading side 400.

The outward angled tines 304 may be biased inwards toward the contact 406 in order to release the contact retention assembly 300 and permit the contact retention assembly 300 to be removed from the housing 402 through the contact loading side 400. For example, the outward angled tines 304 may be biased to positions shown by the dashed lines in FIG. 6 using a tool or other object (not shown) inserted into a gap 604 that is accessible from the mating side 508. The tool may then bias the outward angled tines 304 towards the contact 406 until the housing engagement surfaces 316 no longer contact or engage the housing ledge 602, or until the housing engagement surfaces 316 are no longer positioned to contact or engage the housing ledge 602 when the contact retention assembly 300 is displaced in the direction of the arrow 516. The contact retention assembly 300 may then be removed from the housing 402. In one embodiment, the outward angled tines 304 are biased towards the contact 406 so that the contact retention assembly 300 may be removed from the housing 402 through the contact opening 404 while the inward angled tines 302 (shown in FIG. 3) are not biased and continue to engage the contact 406 and prevent the contact 406 from being separated from the contact retention assembly 300 in the direction of the arrow 516. For example, the outward angled tines 304 may be biased inwards so that the contact 406 and contact retention assembly 300 may be removed from the housing 402 together.

In an alternative embodiment, rather than engaging the housing ledge 602 to prevent the contact retention assembly 300 from being removed from the housing 402, the outward angled tines 304 may engage another feature of the housing 402. For example, the outward angled tines 304 may engage one or more recesses (not shown), shoulders, protrusions or other features in the housing 402.

During assembly, the contact retention assembly 300 is initially coupled to the contact 406 by inserting the contact 406 into the contact retention assembly 300 until the inward angled tines 302 (shown in FIG. 3) engage the contact 406. The contact retention assembly 300 and the contact 406 are then loaded into the housing 406 through the contact opening 404. The outward angled tines 304 may be slightly biased inward as the contact retention assembly 300 is inserted into the contact opening 404. Once the outward angled tines 304 are inserted past the housing ledge 602, the outward angled tines 304 may no longer be biased and may be released to engage the housing ledge 602. In an alternative embodiment, the contact 406 may first be loaded into the housing 402 through the contact opening 404. The contact retention assembly 300 may then be loaded into the housing 406 through the contact opening 404. The contact retention assembly 300 may be inserted until the inward angled tines 302 engage the contact 406. As described above, the outward angled tines 304 may be biased inwards as the contact retention assembly 300 is loaded into the housing 402 until the outward angled tines 304 are inserted past the housing ledge 602.

Figure 7:
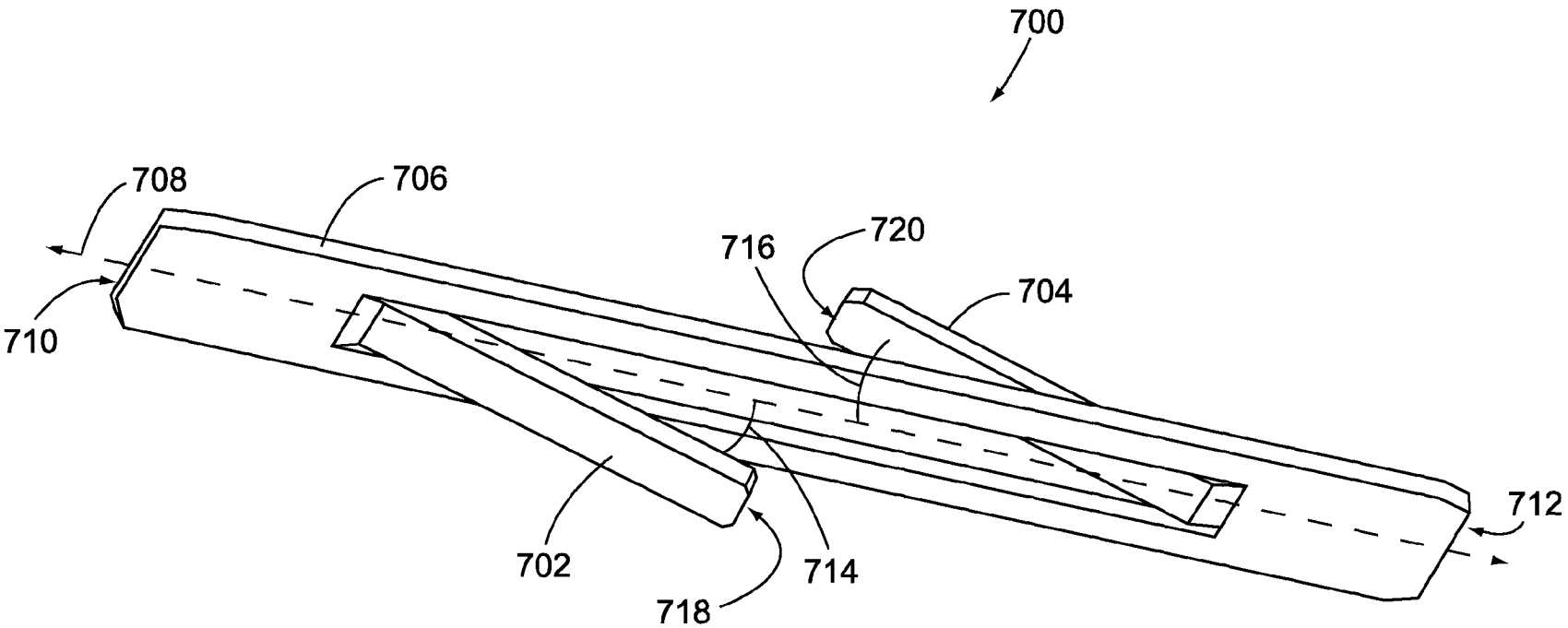
FIG. 7 is a perspective view of a contact retention assembly according to an alternative embodiment.

FIG. 7 is a perspective view of a contact retention assembly 700 according to an alternative embodiment. The contact retention assembly 700 may be used as an alternative to the contact retention assembly 300 (shown in FIG. 3). For example, the contact retention assembly 700 may be used to retain the contact 406 (shown in FIG. 4) within the housing 402 (shown in FIG. 4). The contact retention assembly 700 includes a plurality of oppositely angled tines 702, 704 connected to a body 706. The body 706 may have a substantially planar shape that is elongated along a longitudinal axis 708. The angled tines 702, 704 may be bent in opposite directions away from the body 706 so that each of the angled tines 702, 704 extends away from opposing sides 710, 712 of the body 706. For example, each angled tine 702, 704 may be bent away from the longitudinal axis 708. The angled tine 702 may extend away from the longitudinal axis 708 by a first angle 714 and the angled tine 704 may extend away from the longitudinal axis 708 by a second angle 716. In one embodiment, the first and second angles 714, 716 are approximately the same. In another embodiment, the first and second angles 714, 716 differ from one another. Each of the angled tines 702, 704 extends between the body 706 and a tine end 718, 720.

With reference to FIG. 5, the contact retention assembly 700 (shown in FIG. 7) may be inserted between the contact 406 and the housing 402 so that the longitudinal axis 708 is substantially parallel to the arrow 516. One of the angled tines 702, 704 may engage the contact 406 while the other angled tine 702, 704 may engage the housing 402. For example, the tine end 718 of the angled tine 702 may engage the contact flange 502 in a manner similar to the contact engagement surfaces 314 of the inward angled tines 302. With reference also to FIG. 6, the tine end 720 of the other angled tine 704 may engage the housing ledge 602 in a manner similar to the housing engagement surfaces 316 of the outward angled tines 304. The contact 406 may be released from engagement with the contact retention assembly 700 by biasing the tine end 718 towards the body 706. The contact 406 may then be removed from the housing 402 through the contact opening 404. The contact retention assembly 700 may be released from engagement with the housing 402 by biasing the tine 704 towards the body 706 so that the tine end 720 does not engage the housing ledge 602. The contact retention assembly 700 may then be removed from the housing 402.

The contact retention assemblies 300, 700 provided in accordance with one or more embodiments described herein permit the secure retention of a contact 406 (shown in FIG. 4) within a housing 402 (shown in FIG. 4) without the need for additional housing components. For example, the contact retention assembly 300, 700 may be used to retain a contact 406 in a single-piece housing 402, without the need for any additional housing components to hold the contact 406 in the housing 402.

Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A contact retention assembly comprising:

a body extending between a front end and a back end;

an outward angled tine extending from the body to an outer housing engagement surface, the housing engagement surface engaging a portion of a housing when the body is loaded into the housing; and an inward angled tine extending from the body to a contact engagement surface, the inward angled tine configured to engage a contact to retain the contact within the assembly, wherein the inward angled tine extends from the body in a different direction than the outward angled tine.

2. The contact retention assembly of claim 1, wherein the outward angled tine prevents removal of the assembly and the contact through an opening on a contact loading side of the housing.

3. The contact retention assembly of claim 1, wherein the inward angled tine prevents removal of the contact from at least one of the assembly and the housing through an opening on a contact loading side of the housing.

4. The contact retention assembly of claim 1, wherein the body is substantially planar with the outward angled tine extending from the body in a first direction and the inward angled tine extending from the body in a second direction.

5. The contact retention assembly of claim 1, wherein the body is tubular and extends along a central axis, the outward angled tine extending away from the central axis at a first angle, the inward angled tine extending towards the central axis at a second angle.

6. The contact retention assembly of claim 1, wherein each of the inward and outward angled tines defines a cantilevered beam.

7. The contact retention assembly of claim 1, wherein the outward angled tine extends from the body proximate the front end and the inward angled tine extends from the body proximate the back end.

8. The contact retention assembly of claim 1, wherein the outward angled tine is bent away from a central axis of the body to an engaging position and the inward angled tine is bent towards the central axis to an engaging position.

9. The contact retention assembly of claim 1, further comprising a second outward angled tine opposing the outward angled tine, the inward facing tine disposed between the outward and second outward angled tines.

10. The contact retention assembly of claim 1, further comprising a second inward angled tine opposing the inward angled tine, the outward angled tine circumferentially disposed between the inward and second inward angled tines.

11. The contact retention assembly of claim 1, further comprising a second outward angled tine and a second inward angled tine, the outward angled tine, second outward angled tine, inward angled tine and second inward angled tine circumferentially disposed approximately 90 degrees from one another.

12. A connector assembly comprising:

a housing extending between a mating side and an opposing side, the mating side configured to mate with a mating connector, the opposing side comprising a contact opening configured to receive a contact; and a contact retention assembly disposed in the contact opening, the contact retention assembly comprising a body with an outward angled tine and an inward angled tine, the outward angled tine extending from the body to an outward tine end that faces the opposing side and engages the housing to prevent the contact retention assembly from being removed from the housing through the contact opening, the inward angled tine extending from the body to an inward tine end that faces the mating side and is configured to engage the contact to prevent the contact from being removed from the housing through the contact opening.

13. The connector assembly of claim 12, wherein the outward angled tine is biased inward when the contact retention assembly is inserted into the contact opening.

14. The connector assembly of claim 12, wherein the contact retention assembly is configured to release the contact from the housing while preventing the contact retention assembly from being removed from the housing by biasing the inward angled tine in a substantially outward direction.

15. The connector assembly of claim 12, wherein the outward angled tine prevents removal of the contact retention assembly from the housing while the inward angled tine retains the contact in engagement with the contact retention assembly until the outward angled tine is biased in a substantially inward direction.

16. The connector assembly of claim 12, wherein the contact retention assembly comprises a substantially planar body with the outward angled tine extending from the body in a first direction, the inward angled tine extending from the body in a second direction.

17. The connector assembly of claim 12, wherein the body is tubular and extends along a central axis, the outward angled tine extending away from the central axis at a first angle, the inward angled tine extending towards the central axis at a second angle.

18. The connector assembly of claim 12, wherein each of the inward and outward angled tines defines a cantilevered beam.

19. The connector assembly of claim 12, further comprising a second outward angled tine opposing the outward angled tine, the inward facing tine circumferentially disposed between the outward and second outward angled tines.

20. The connector assembly of claim 12, further comprising a second inward angled tine opposing the inward angled tine, the outward angled tine circumferentially disposed between the inward and second inward angled tines.

* * * * *